United States Patent [19]

Brown et al.

[11] Patent Number: 4,842,037

[45] Date of Patent: Jun. 27, 1989

[54] METAL CASTING PATTERNS

[75] Inventors: John R. Brown, Shifnal; Nigel K. Graham, Tamworth; Russell A. King, Sutton Coldfield, all of United Kingdom

[73] Assignee: Foseco International Limited, Birmingham, England

[21] Appl. No.: 194,566

[22] Filed: May 16, 1988

[30] Foreign Application Priority Data

Jun. 10, 1987 [GB] United Kingdom ..... 8713569
Dec. 5, 1987 [GB] United Kingdom ..... 8728489

[51] Int. Cl.[4] ..... B22C 7/02; B22C 9/04

[52] U.S. Cl. ..... 164/45; 164/34; 164/134; 164/244; 164/249; 264/45.4; 264/275

[58] Field of Search ..... 164/45, 34, 35, 36, 164/134, 246, 249, 358, 362, 244; 264/45.4, 275

[56] References Cited

U.S. PATENT DOCUMENTS

| | | | |
|---|---|---|---|
| 3,314,116 | 4/1967 | Wittmoser et al. . | |
| 3,339,620 | 9/1967 | Krzyzanowski et al. . | |
| 4,415,513 | 11/1983 | Plachy | 264/45.4 |
| 4,612,968 | 9/1986 | Ashton et al. . | |
| 4,660,623 | 4/1987 | Ashton . | |

FOREIGN PATENT DOCUMENTS

| | | | |
|---|---|---|---|
| 8437376 | 4/1985 | Fed. Rep. of Germany . | |
| 51-41064 | 4/1976 | Japan | 264/45.4 |
| 57-178728 | 11/1982 | Japan | 264/45.4 |
| 61-172649 | 8/1986 | Japan | 164/34 |
| 6614353 | 6/1967 | Netherlands | 164/358 |
| WO79/00795 | 10/1979 | PCT Int'l Appl. | 164/45 |
| 850331 | 10/1960 | United Kingdom . | |
| 916784 | 1/1963 | United Kingdom . | |
| 923862 | 4/1963 | United Kingdom . | |
| 1004352 | 9/1965 | United Kingdom . | |
| 1054421 | 1/1967 | United Kingdom . | |
| 1377691 | 12/1974 | United Kingdom . | |
| 1388911 | 3/1975 | United Kingdom . | |
| 1388912 | 3/1975 | United Kingdom . | |
| 1388913 | 3/1975 | United Kingdom . | |
| 1419762 | 12/1975 | United Kingdom . | |
| 2008427B | 6/1979 | United Kingdom . | |

*Primary Examiner*—Nicholas P. Godici
*Assistant Examiner*—J. Reed Batten, Jr.
*Attorney, Agent, or Firm*—Nixon & Vanderhye

[57] ABSTRACT

A metal casing pattern of expanded thermoplastics material such as polystyrene or polymethyl methacrylate has a filter comprising a porous ceramic body, such as a body having pores extending from one face to another face or a foam structure, incorporated therein.

6 Claims, 2 Drawing Sheets

METAL CASTING PATTERNS

Figure 1:
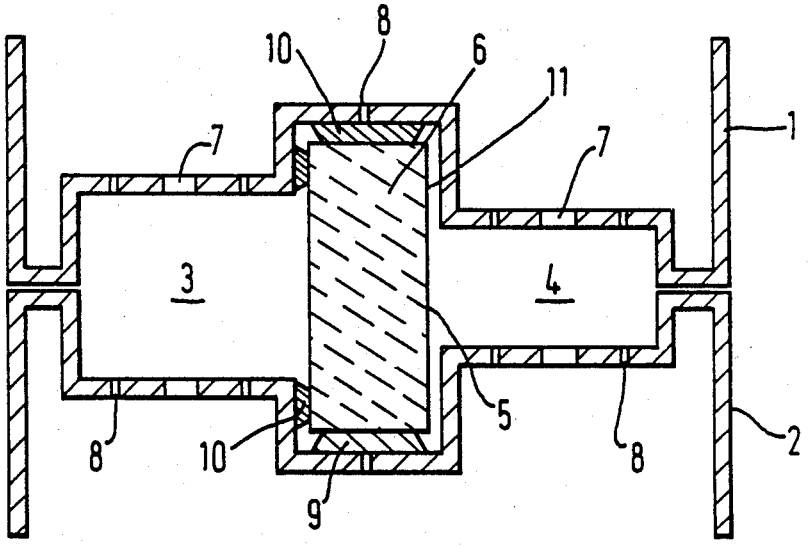

This invention relates to metal casting patterns of expanded thermoplastic material having a filter therein.

Patterns of expanded thermoplastic material, such as expanded polystyrene, are used in the so-called Full Mould or Lost Foam process of casting molten metal. One or more such patterns, corresponding to the metal casting to be produced and to the sprue, and mould runner system are coated with a refractory coating and embedded in unbonded sand in a moulding box to form a mould. When molten metal is poured into the mould the pattern is decomposed and replaced by the metal which solidifies to produce a casting having the shape and configuration of the pattern.

The expanded polystyrene pattern which is used in the process is commonly produced by partially expanding polystyrene beads containing a volatile blowing agent such as pentane under the action of heat, injecting the partially expanded beads into a mould, usually made of metal, such as aluminum, and then further expanding the beads under the action of heat in the mould so causing the beads to fuse together to form the pattern. Usually heating in the mould is done by injecting steam into the mass of partially expanded beads.

In the Full Mould or Lost Foam process it is common practice to produce a number of castings in a single mould, using a simple running system consisting of a sprue or sprue and runner bar and a series of ingates, each ingate linking either the sprue or the runner bar to a casting pattern, and the casting pattern, sprue, runner bar and ingates are all made of expanded polystyrene. Each ingate must be relatively large as it must support the mass of the casting pattern when the assembly is coated with refractory coating and invested in the unbonded moulding sand.

In such a process it is diffucilt to incorporate conventional slag traps and it is also difficult to ensure that the runner bar remains full of molten metal during casting so that any slag floates to the top and is trapped in the runner bar when the metal solidifies. For these reasons slag defects are common in iron castings and oxide film defects are common in aluminum castings.

Similar defects can be prevented in other types of process using bonded sand moulds because a print can be incorporated in the runner system and a filter can be inserted into the print. This remedy is not possible in the Full Mould or Lost Foam process because all the parts of the mould are formed of expanded polystyrene and there is nowhere for the filter to be located.

It has now beed found that a filter can be used in the Full Mould or Lost Foam process if the filter is incorporated in a pattern of expanded thermoplastics material during production of the pattern.

According to the invention there is provided a metal casting pattern of expanded thermoplastics material having incorporated therein a filter comprising a porous ceramic body.

According to a further feature of the invention there is provided a method of making a metal casting pattern of expanded thermoplastics material having a filter comprising a porous ceramic body therein comprising locating the filter in a die or mould having an internal shape conforming to the shape of the pattern so that all porous surfaces of the filter are accessible to thermoplastics material when the thermoplastics material is introduced into the die or mould, introducing beads of the thermoplastics material into the die or mould until the die or mould is filled and heating the beads so as to expand and cure the beads and form the pattern.

The metal casting pattern according to the invention may be a pattern for forming the sprue, runner or a part of the sprue or of the runner of a Full Mould or Lost Foam process mould, or the pattern may form the metal casting and the runner or a part of the runner and have the filter incorporated in the runner or runner part.

The expanded thermoplastics material is preferably expanded polystyrene or polymethyl methacrylate and it is in relation to the production of expanded polystyrene patterns that the invention will be described in detail.

The porous body may be for example a honeycomb type of structure having pores which extend from one face of the body to another face or a structure having interconnecting pores such as a ceramic foam.

Foam structures are preferred and such structures may be made using a known method of making a ceramic foam in which an organic foam, usually a polyurethane foam, is impregnated with an aqueous slurry of ceramic material containing a binder, the impregnated foam is dried to remove water and the dried impregnated foam is fired to burn off the organic foam to produce a ceramic foam. The production of ceramic foams by this method is described in U.S. Pat. No. 3,090,094 and in British Pats. Nos. 923862, 916784, 1004352, 1054421, 1377691, 1388911, 1388912 and 1388913.

When the pattern of the invention is produced it is essential that at least the exterior surfaces of the filter which are to be in contact with the molten metal during casting are substantially covered with polystyrene, otherwise coating material could penetrate inside the filter when the pattern is coated with the refractory coating prior to use, or sand could enter the filter when the pattern is invested with unbonded sand.

When the filter is of the honeycomb type, i.e. having pores which extend from one face of the filter to the opposite face, it is only necessary to ensure that the filter is located in a die or mould for producing the pattern in such a manner that partially expanded polystyrene beads are blown around the faces which are to contact molten metal because the remaining surfaces of the filter are not porous and no problems could arise if these surfaces are exposed to the refractory coating or to the unbonded sand.

Similarly if the filter is a ceramic foam in which those surfaces which are not intended to pass molten metal are rendered impermeable, for example by the application of a glaze as described in British Pat. No. 1419762, by the application of a plastics coating or by means of adhesive tape, only the porous faces need be covered by polystyrene during production of the pattern.

Ceramic foam filters are usually in the foam of square or rectangular cross-section boards whose major surfaces are intended to pass molten metal. During the production of such filters organic foam which has been impregnated with a slurry of ceramic material is usually passed through rolls to distribute the slurry and remove excess slurry. As a result two opposite minor faces of the filters are closed by the squeezing operation while the other two minor faces remain open.

In order to produce patterns according to the invention containing such filters it is necessary to ensure that not only the major faces of the filter but also the minor faces are substantially covered by polystyrene. The filter must therefore be located in a die or mould so that there is a gap between the minor faces and the inner surface of the die and partially pre-expanded beads of polystyrene can be blown around all faces of the filter. The gap is preferably at least 2 mm so that a minimum of 2 mm of polystyrene covers each face.

Ceramic foam filters have a dimensional tolerance of about 1 mm, so in order to allow for size variations and to ensure that all filters of a given nominal size can be located accurately in the die or mould and substantially covered with polystyrene, movable means such as spring loaded wedges or knife edges may be used to locate and hold the filters in the desired position. In order to prevent the filter from being abraded by the wedges or knife edges it may be desirable to protect those surfaces which are contacted by the wedges or knife edges by means of a coating or an adhesive tape. If desired the spring loaded wedges or knife edges may be used in combination with fixed wedges or knife edges.

During production of the metal casting pattern according to the invention it is desirable that polystyrene beads enter and at least partially fill the surface pores or surface cells of the filter. When the filter is a ceramic foam in cells are usually larger than the size range of partially pre-expanded polystyrene beads which are used for pattern production and penetration of the beads into the cells will occur automatically. The size of the pores or channels in a ceramic honeycomb type of filter is usually smaller than the size of the cells in a ceramic foam and it may be necessary to choose a polystyrene bead size which is sufficiently small to ensure that penetration takes place. As a result of the penetration of the polystyrene into the filter a strong pattern is produced and there is no danger of the polystyrene surrounding the filter breaking away from the filter during handling or use of the pattern.

In use the pattern of the invention is coated with a refractory coating, surrounded by dry sand in a suitable moulding box and vibrated to compact the sand and metal is then poured, according to conventional practice, with or without vacuum applied to the sand. When the metal is cast the expanded polystyrene pattern is destroyed and replaced by the metal.

Figure 2:
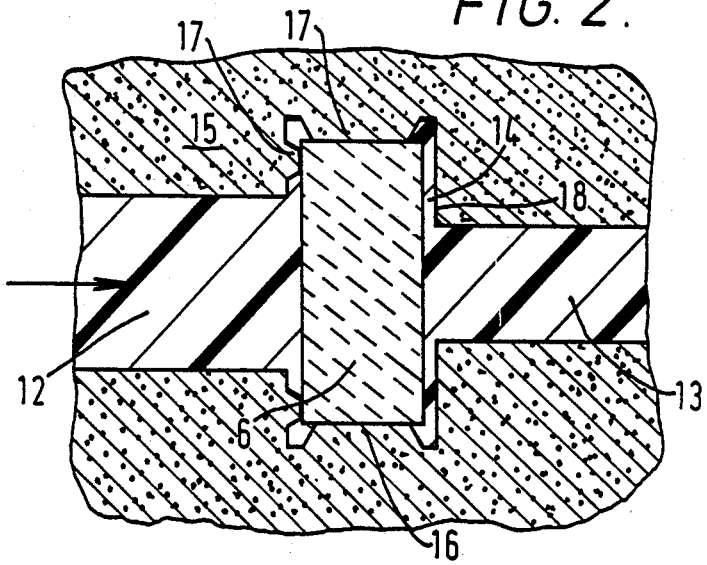
Figure 3:
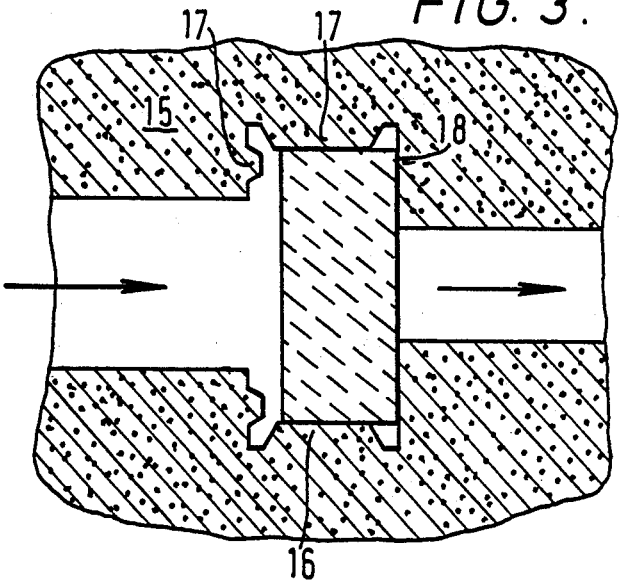

The invention is illustrated with reference to the accompanying drawings in which:

FIG. 1 is a vertical cross-section through a die for producing an expanded polystyrene mould runner pattern having a ceramic foam filter therein according to the invention and FIGS. 2 and 3 are vertical cross-sections through part of a metal casting mould containing a polystyrene runner pattern having a ceramic foam filter therein, produced in the die of FIG. 1.

Referring to FIG. 1 an aluminum die for producing an expanded polystyrene mould runner pattern having a ceramic foam filter therein consists of an upper half 1 and a lower half 2 shaped so as to form together cavities 3 and 4 for the runner pattern and cavity 5 for a ceramic foam filter 6 in the shape of a square cross-section board. The upper half 1 of the die has filler nozzles 7 for admitting partially pre-expanded polystyrene beads and both the upper half 1 and the lower half 2 have vents 8 for admitting and venting steam. The inner surface of both halves 1, 2 around the cavity 5 has a combination of fixed and spring loaded wedges for locating and holding the filter 6. The horizontal surface of the lower half 2 has a fixed wedge 9 and the horizontal surface of the upper half 1 and the vertical surfaces of both halves 1, 2 (apart from the vertical surfaces adjacent face 11 of the filter 6) have spring loaded wedges 10. The filter 6 is located in the desired position so as to leave a gap of at least 2 mm between the inner surface of the die and all faces of the filter 6. The pattern is produced by injecting partially pre-expanded polystyrene beads through the nozzles 7 into cavity 4 and then cavity 3 until the die is filled. Steam is then injected through the vents 8 so as to fully expand and cure the beads to form the mould runner pattern. Prior to use in a mould the pattern is coated with a refractory coating.

Referring to FIGS. 2 and 3 an expanded polystyrene runner pattern which consists of a first runner section 12 and a second runner section 13 and between the two runner sections a section 14 containing the ceramic foam filter 6 is surrounded by dry sand 15 in a moulding box (not shown) and the box is vibrated to compact the dry sand 15 around the pattern. At points corresponding to the positions of the wedges in the die used to produce the pattern there are wedge shaped recesses 16 and 17 in the surface of the pattern. The cross-sectional area of the runner section 12 is larger than that of the runner section 13. When molten metal is poured into the mould so that it flows in the direction indicated by the arrows the expanded polystyrene is destroyed by the advancing metal front. Under the pressure of the metal the filter 6 is pushed against the refractory coating and sand at the outlet side 18 of the mould thus preventing molten metal leaking around the sides and outlet face 11 of the filter 6. If the runner sections 12 and 13 were of the same cross-sectional area pressure would not be exerted on the filter 6 and it would be possible for metal to leak around the filter 6 once the polystyrene surrounding the sides of the filter 6 was destroyed.

We claim:

1. A metal casting pattern of expanded thermoplastics material, said pattern comprising:

a first sprue or runner part;

a second sprue or runner part; and a filter comprising a porous ceramic body located between said two parts, the cross-sectional area of the first part being larger than that of the second part, said porous ceramic body being a foam structure and being totally enclosed in said expanded thermoplastics material.

2. A metal casting pattern according to claim 1, wherein said first sprue or runner part and said second sprue or runner part are for a full mould process mold.

3. A metal casting pattern according to claim 1, wherein the surface pores or cells of said filter are at least partially filled with said expanded thermoplastics material.

4. A metal casting pattern according to claim 1, wherein said expanded thermoplastics material is polystyrene or polymethyl methacrylate.

5. A method of making a metal casting pattern of expanded thermoplastics material comprising a first sprue or runner part, a second sprue or runner part, and a filter comprising a porous ceramic body located between the two parts, the cross-sectional area of the first part being larger than that of the second part, said filter being totally enclosed in the thermoplastics material, said method comprising the steps of:

locating said filter in a die or mould having an internal shape conforming to the shape of the pattern so that all porous surfaces of the filter are accessible to thermoplastics material when said thermoplastics material is introduced into the die or mould; and introducing beads of said thermoplastics material into the die or mould until the die or mould is filled, said beads of thermoplastics material having a size which is smaller than the size of the pores or cells of the ceramic body to ensure that said beads penetrate into said ceramic body; and heating said beads so as to expand and cure said beads to form said pattern.

6. A method according to claim 5, wheein said die or mould has a combination of fixed and spring-loaded wedges for locating said filter in position, said filter being located so as to leave a gap of at least 2 mm between an inner surface of the die or mould and all faces of the filter.

* * * * *